US007440711B2

(12) United States Patent
Kishi et al.

(10) Patent No.: US 7,440,711 B2
(45) Date of Patent: Oct. 21, 2008

(54) IMAGE-FORMING APPARATUS HAVING CLEANING ROLLER TO REMOVE TONER FROM TRANSFER ROLLER THAT FACILITATES TRANSFERRING TONER IMAGE FROM IMAGE-BEARING MEMBER TO RECORDING MATERIAL

(75) Inventors: Takehiro Kishi, Toride (JP); Ryuta Ai, Toride (JP); Yasushi Takeuchi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 11/469,172

(22) Filed: Aug. 31, 2006

(65) Prior Publication Data

US 2007/0059029 A1 Mar. 15, 2007

(30) Foreign Application Priority Data

Sep. 13, 2005 (JP) ..... 2005-264854

(51) Int. Cl.
*G03G 15/16* (2006.01)

(52) U.S. Cl. ..... 399/101; 399/297; 399/302

(58) Field of Classification Search ..... 399/101, 399/99, 297, 302, 353–354, 357, 359–360
See application file for complete search history.

(56) References Cited

U.S. PATENT DOCUMENTS 4,469,435 A * 9/1984 Nosaki et al. ..... 399/148
5,101,238 A * 3/1992 Creveling et al. ..... 399/101
5,233,398 A * 8/1993 Nimura et al. ..... 399/354

FOREIGN PATENT DOCUMENTS

| | | |
|---|---|---|
| JP | 61-073948 | 4/1986 |
| JP | 02-93674 | 4/1990 |
| JP | 06-059856 | 3/1994 |
| JP | 2000-122447 | 4/2000 |
| JP | 2004-310060 | 11/2004 |
| JP | 2005-315987 | 11/2005 |

* cited by examiner

*Primary Examiner*—David M Gray
*Assistant Examiner*—Geoffrey T Evans
(74) *Attorney, Agent, or Firm*—Canon USA Inc IP Div

(57) ABSTRACT

An image-forming apparatus includes an image-bearing member supporting a toner image; a transfer roller that rotates in contact with the image-bearing member so as to transfer the toner image to a recording material; first and second cleaning rollers, each having a brush provided on a circumferential surface thereof so as to electrostatically recover toner deposited on the transfer roller while rotating in contact therewith; a recovery roller that rotates in contact with the first and second cleaning rollers to electrostatically recover the toner therefrom; and a blade-like removing member that comes in contact with the recovery roller so as to remove the toner therefrom.

7 Claims, 6 Drawing Sheets

IMAGE-FORMING APPARATUS HAVING CLEANING ROLLER TO REMOVE TONER FROM TRANSFER ROLLER THAT FACILITATES TRANSFERRING TONER IMAGE FROM IMAGE-BEARING MEMBER TO RECORDING MATERIAL

BACKGROUND OF THE INVENTION

1. Field of the Invention

The present invention relates to electrophotographic image-forming apparatuses, and particularly relates to a removing member for removing toner (developer) deposited on a transfer roller for transferring a toner image from an image-bearing member to a recording material.

2. Description of the Related Art

Electrophotographic image-forming apparatuses have recently presented the problem of toner deposited on the backside of a recording material with increasing demand for higher print quality.

Japanese Patent Laid-Open No. 2000-122447, for example, discloses a blade disposed in contact with a transfer roller to remove toner deposited on the backside of a recording material.

As this blade rubs against the transfer roller, however, the blade undesirably wears the roller and shortens the lifespan thereof.

FIG. 7 illustrates a process for electrostatically removing toner to avoid the above problem. In FIG. 7, a fur brush roller 18*a* is biased to recover toner deposited on a transfer roller 11 for transferring a toner image from an intermediate transfer belt (image-bearing member) 6 to a recording material S. A bias roller 19 in turn electrostatically recovers the toner from the fur brush roller 18*a*. Finally, a blade 20 removes the toner from the bias roller 19. This process requires a larger current flowing between the fur brush roller 18*a* and the transfer roller 11 to stably remove the toner.

Increasing the bias voltage applied to the fur brush roller 18*a*, however, induces discharge between the fur brush roller 18*a* and the intermediate transfer belt 6. The discharge causes the retransfer of the toner from the fur brush roller 18*a* to the transfer roller 11 and thus results in defective cleaning. On the other hand, increasing the diameter of the fur brush roller 18*a* can widen the contact area between the fur brush roller 18*a* and the transfer roller 11, although this approach undesirably increases the size of the apparatus.

SUMMARY OF THE INVENTION

The present invention is directed to a compact image-forming apparatus that can electrostatically remove toner deposited on a transfer roller with high efficiency.

An image-forming apparatus according to one aspect of the present invention includes an image-bearing member configured to support a toner image; a transfer roller that rotates in contact with the image-bearing member so as to transfer the toner image to a recording material; first and second cleaning rollers, each having a brush provided on a circumferential surface thereof to electrostatically recover toner deposited on the transfer roller while rotating in contact therewith; a recovery roller that rotates in contact with the first and second cleaning rollers so as to electrostatically recover the toner therefrom; and a blade-like removing member that comes in contact with the recovery roller so as to remove the toner therefrom.

In the present invention, the two cleaning rollers and the recovery roller that comes in contact with the cleaning rollers can be provided to successfully remove the toner deposited on the transfer roller without increasing the size of the apparatus.

Further features of the present invention will become apparent from the following description of exemplary embodiments with reference to the attached drawings.

DESCRIPTION OF THE EMBODIMENTS

Embodiments of the present invention will now be described in detail.

An image-forming apparatus including a cleaning unit according to an embodiment of the present invention will be described below with reference to the drawings.

Overall Structure of Image-Forming Apparatus

Figure 1:
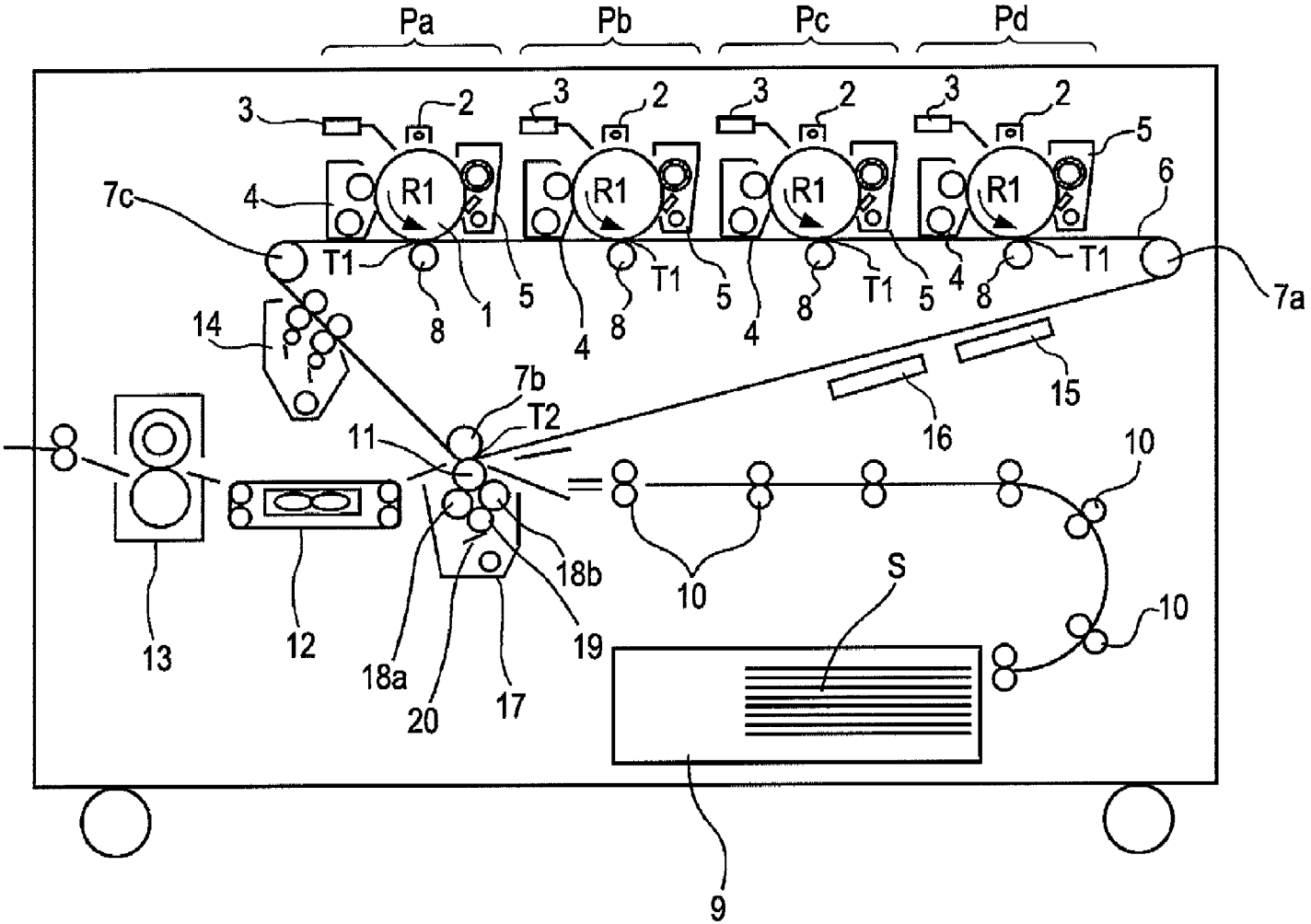
FIG. 1 is a schematic sectional view of an image-forming apparatus according to an embodiment of the present invention.

First, the overall structure of the image-forming apparatus will be described below with reference to FIG. 1. FIG. 1 is a schematic sectional view of the image-forming apparatus.

This image-forming apparatus includes, from left to right in FIG. 1, an image-forming station Pa for forming a yellow toner image, an image-forming station Pb for forming a magenta toner image, an image-forming station Pc for forming a cyan toner image, and an image-forming station Pd for forming a black toner image. The four image-forming stations Pa to Pd have the same structure and differ only in the color of toner (developer). The structure of the image-forming stations Pa to Pd will be briefly described below with the yellow image-forming station Pa as an example.

The image-forming station Pa includes a photosensitive drum (image-bearing member) 1 that is surrounded by a charging unit 2, an exposing unit 3, a developing unit 4, a first transfer roller (first transfer member) 8, and a cleaning unit 5 in the rotational direction of the drum 1. The photosensitive drum 1 can be rotated counterclockwise in FIG. 1 (in a direction indicated by the arrow R1). The charging unit 2 positively uniformly charges the surface of the photosensitive drum 1. The exposing unit 3 selectively exposes the charged photosensitive drum 1 according to image information to form an electrostatic image thereon. The developing unit 4 develops the electrostatic image with negatively charged toner to form a toner image on the photosensitive drum 1. The first transfer roller 8 transfers the toner image from the photosensitive drum 1 to an intermediate transfer belt (intermediate transfer member or image-bearing member) 6. The cleaning unit 5 is disposed downstream in the rotational direction of the photosensitive drum 1 to remove the toner left thereon after the transfer of the toner image.

Figure 4:
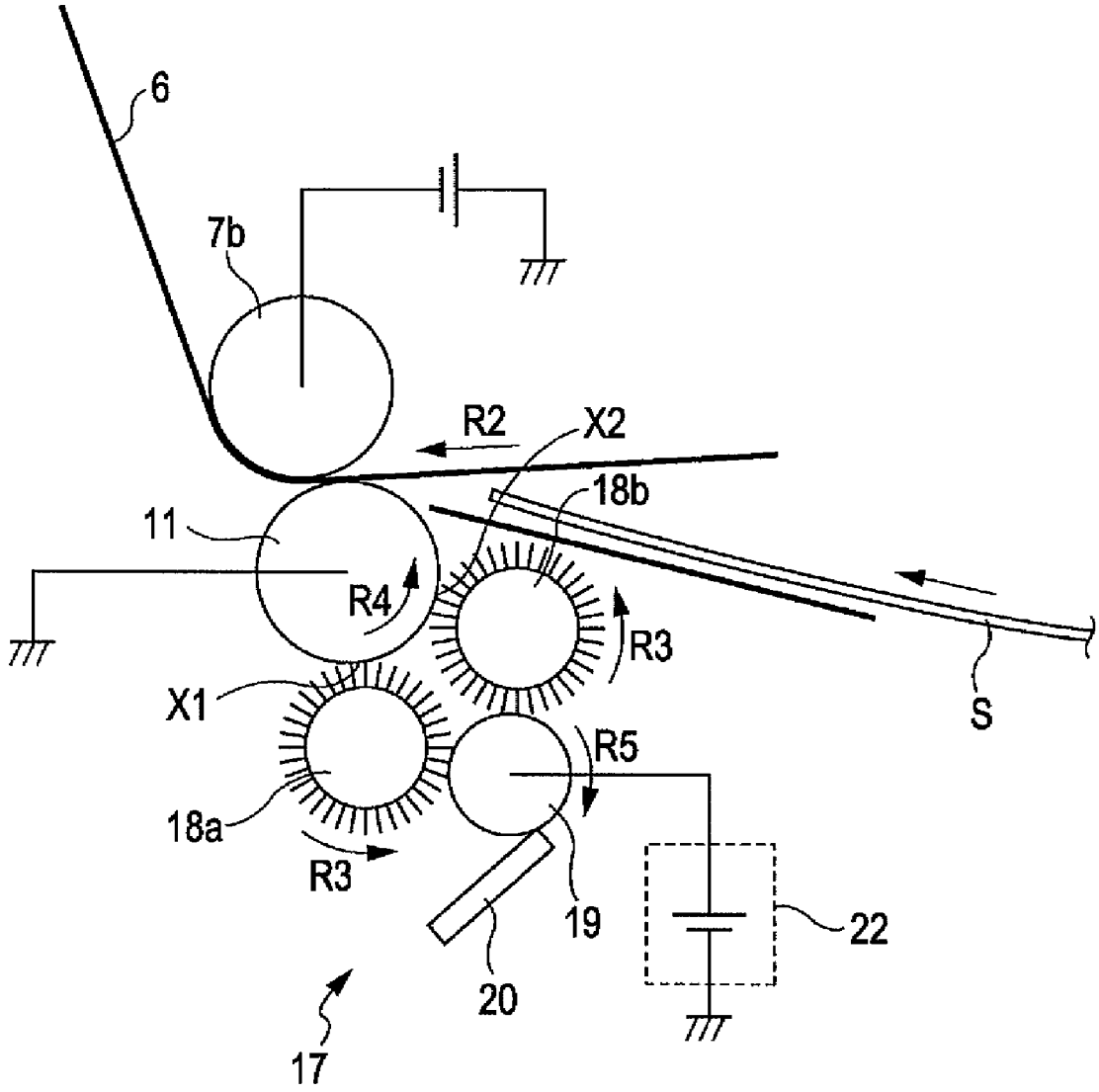
FIG. 4 is a schematic diagram of a cleaning unit in a second transfer section in the embodiment.

The four image-forming stations Pa to Pd are arranged in series in the direction in which the intermediate transfer belt 6 moves (in a direction indicated by the arrow R2 in FIG. 4).

The intermediate transfer belt 6 runs around a drive roller 7*a* and driven rollers 7*b* and 7*c* so as to come in contact with the photosensitive drums 1 of the four image-forming stations Pa to Pd. The intermediate transfer belt 6 rotates clockwise in FIG. 1 (in the direction indicated by the arrow R2 in FIG. 4) as the drive roller 7*a* is rotated by a drive unit (not shown). The toner images formed on the photosensitive drums 1 are transferred to the intermediate transfer belt 6 in first transfer sections T1 where the first transfer rollers 8 are disposed.

A bias voltage having a polarity opposite that of the toner is applied to the first transfer rollers 8 by a power supply (not shown) to transfer the toner images from the photosensitive drums 1 to the intermediate transfer belt 6 (first transfer).

The first transfer rollers 8 sequentially transfer the yellow, magenta, cyan, and black toner images formed at the image-forming stations Pa, Pb, Pc, and Pd, respectively, to the intermediate transfer belt 6. These toner images are superimposed into a color image on the intermediate transfer belt 6.

A transfer material cassette 9 storing a transfer material S is disposed on the bottom of the apparatus. The transfer material S is fed from the transfer material cassette 9 to a second transfer section T2 by pairs of feed rollers (transfer material conveyors) 10. An outer second transfer roller 11 (second transfer member or roller) is disposed opposite the driven roller 7*b* (hereinafter also referred to as "inner second transfer roller") in the second transfer section T2. The outer second transfer roller 11 rotates in a direction indicated by the arrow R4 in FIG. 4 and comes in contact with the intermediate transfer belt 6 so as to form a nip.

The outer second transfer roller 11 is electrically grounded. The inner second transfer roller 7*b* is biased by a power supply (not shown).

The transfer material S is fed to the second transfer section T2 in synchronization with the formation of the images on the intermediate transfer belt 6. The outer second transfer roller 11 comes in contact with the intermediate transfer belt 6 over a width of about 3 mm in the second transfer section T2. A DC bias voltage of about −1 to −3 kV is applied to the inner second transfer roller 7*b* to form an electric field between the outer second transfer roller 11 and the inner second transfer roller 7*b*. The action of the electric field transfers the toner image from the intermediate transfer belt 6 to the transfer material S (second transfer).

A feed belt 12 then conveys the transfer material S having the toner image to a fusing unit 13 which fuses the toner image by heating and pressing before the ejection of the transfer material S. A belt-cleaning unit 14 removes the toner left on the intermediate transfer belt 6 after the transfer of the toner image to the transfer material S.

Detection of Registration Marks and Density Patches

A patch sensor 15 for detecting reference density patches formed on the intermediate transfer belt 6 and a registration mark sensor 16 for detecting registration marks formed on the intermediate transfer belt 6 are disposed near the intermediate transfer belt 6.

Toner images of the four colors must be superimposed at the same position on the intermediate transfer belt 6 without misalignment in the image formation of the image-forming stations Pa to Pd. To align the toner images, registration marks (toner images for detection) are formed on the intermediate transfer belt 6 at the image-forming stations Pa to Pd and are read by the registration mark sensor 16. The timing for exposure by the exposing units 3 (exposure conditions) is adjusted according to the read results (detection results) so that the toner images can be superimposed at the same position on the intermediate transfer belt 6 at the image-forming stations Pa to Pd.

Figure 2:
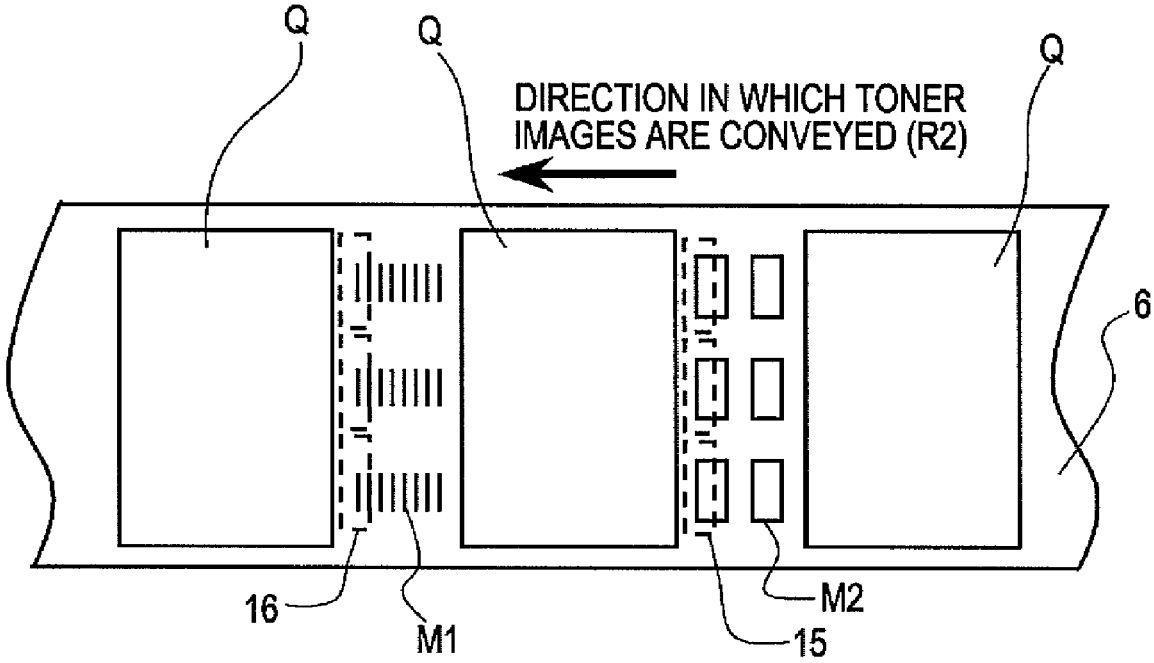
FIG. 2 is a schematic diagram of automatic registration patches in the embodiment.

In the known art, registration marks are formed by, for example, inserting a sequence for adjusting the timing for forming after the completion of a print job. In this embodiment, as shown in FIG. 2, registration marks M1 are formed between image-bearing areas Q and are read by the registration mark sensor 16 to adjust the timing for forming. The registration marks M1 can thus be formed and read during a print job to improve the productivity of the image-forming process.

In this embodiment, similarly, density patches (toner images for detection) M2 are formed between the image-bearing areas Q and are read by the patch sensor 15 to adjust the density for forming images (conditions where toner images are formed). This allows continuous printing with stable image densities.

In the known art, if registration marks and density patches are formed between image-bearing areas, a bias voltage having a polarity opposite that of a transfer bias voltage is applied to an inner second transfer roller to prevent such unnecessary toner images from being transferred to an outer second transfer roller. A delay in bias switching, however, can cause defective transfer at the front or rear end of a transfer material.

In this embodiment, the registration marks M1 and the density patches M2 are transferred to the outer second transfer roller 11, rather than performing bias switching. A cleaning unit cleans the outer second transfer roller 11 to prevent the transfer of the unnecessary toner images from the outer second transfer roller 11 to the transfer material S.

Second Transfer Section

The intermediate transfer belt 6, the outer second transfer roller 11, and the inner second transfer roller 7*b*, which are associated with the second transfer, will be described in detail below.

The intermediate transfer belt 6 can be an endless belt that moves in the direction indicated by the arrow R2 at about 300 mm/s during the image formation.

In this embodiment, the intermediate transfer belt 6 is formed of an elastic belt including a surface layer for bearing a toner image, an elastic layer for providing the surface layer with elasticity, and a resin layer for limiting the elongation of the intermediate transfer belt 6 due to a tension applied thereto. The surface layer is the outermost layer while the resin layer is the innermost layer. The elastic layer is disposed therebetween.

The total thickness of these three layers, that is, the thickness of the intermediate transfer belt 6, may be about 0.1 to 1.5 mm.

The resin layer may be formed of a resin such as polycarbonate, polystyrene, or a fluoropolymer (e.g., an ethylene-tetrafluoroethylene copolymer (ETFE) or polyvinylidene fluoride (PVDF)). The elastic layer may be formed of an elastic material (elastic rubber or elastomer) such as butyl rubber, fluorocarbon rubber, or acrylic rubber. Although the material used for the surface layer is not particularly limited, the surface layer may be formed of a material that can reduce the adhesion of toner to the surface of the intermediate transfer belt 6 to facilitate the second transfer. Examples of the material used include, but not limited to, resins such as polyurethane, polyester, and epoxy resin.

In addition, a resistance modifier such as carbon is dispersed in the surface layer, the resin layer, and the elastic layer to adjust the volume resistivities thereof to about $1\times10^8$ Ω·cm.

The elastic layer allows the intermediate transfer belt 6 to form a high-quality image without dropping characters, enhance transfer efficiency with a reduced amount of toner left after transfer, and facilitate transfer to thick sheets and irregular paper.

Figure 3:
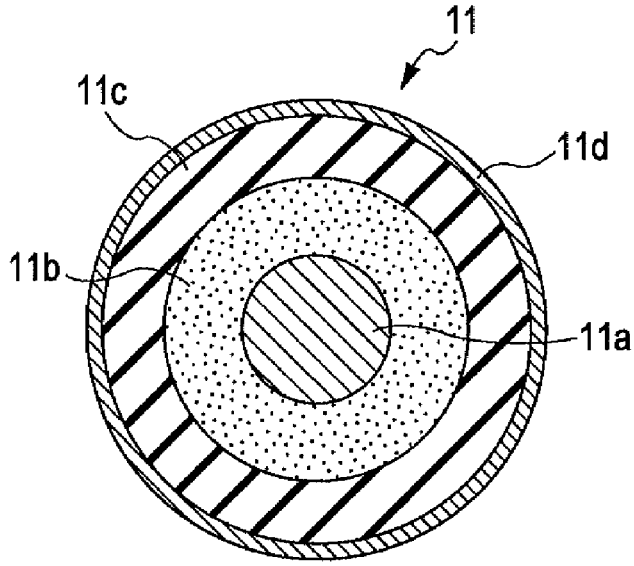
FIG. 3 is a schematic sectional view of an outer second transfer roller in the embodiment.

In this embodiment, the outer second transfer roller 11 has at least two layers including an elastic rubber layer and a surface layer. Referring to FIG. 3, the outer second transfer roller 11 includes a metal core 11*a*, an elastic rubber layer composed of a sponge layer 11*b* and a solid rubber layer 11*c*, and a surface layer l1*d*. The sponge layer 11*b* can be formed of a foamed rubber having a cell diameter of about 0.05 to 1.0 mm. The two elastic rubber layers 11*b* and 11*c* surround the metal core 11*a*.

The surface layer 11*d* can be formed of a fluoropolymer in which an ion-conductive polymer is dispersed and has a thickness of about 0.1 to 1.0 mm. In this embodiment, the outer second transfer roller 11 is a rotating roller having an outer diameter of about 24 mm.

The surface roughness Rz of the surface layer 11*d* may be adjusted to more than 1.5 μm, particularly more than 2 μm, in terms of the ease of feeding of the transfer material S. On the other hand, the surface roughness Rz of the surface layer 11*d* may be adjusted to less than 10 μm, particularly less than 5 μm, in terms of, for example, the ease of cleaning. That is, the surface roughness Rz of the surface layer 11*d* may be adjusted to 1.5 μm<Rz<10 μm, particularly 2 μm<Rz<5 μm. The feeding of the transfer material S can thus be stabilized by providing the surface layer 11*d* with the surface thereof uniformly roughened.

Examples of the fluoropolymer used for the surface layer 11*d* include tetrafluoroethylene-hexafluoropropylene copolymers (FEP), perfluoroalkoxy resins (PFA), and polyvinylidene fluoride (PVDF). Examples of the ion-conductive polymer used as a conducting agent include polymers combined with a quaternary ammonium base, such as copolymers (with styrene, for example) of a (meth)acrylate having a quaternary ammonium base combined with its carboxyl group and copolymers of a (meth)acrylate and a maleimide combined with a quaternary ammonium base; polymers combined with an alkali metal sulfonate such as sodium sulfonate (e.g., sodium polysulfonate); and polymers at least having an alkyloxide-based hydrophilic unit combined with a branch thereof, such as polyethylene oxide or polyethylene glycol-polyamide copolymers, polyethylene-epichlorohydrin copolymers, and polyetheramideimide or polyether block copolymers. The use of such an ion-conductive polymer as a conducting agent results in smaller variations in resistance due to the transfer voltage than the use of carbon black alone. In addition, the use of a fluoropolymer with low surface energy as exemplified above stabilizes the feeding of the transfer material S.

In this embodiment, the outer second transfer roller 11 has an Asker C hardness of about 33°, which can be achieved by adjusting the cell diameter of the sponge layer 11*b*. The Asker C hardness is measured five seconds after the application of a force of about 500 g.

The outer second transfer roller 11 may have an Asker C hardness of about 18° to 45°.

If the hardness falls below 18°, the outer second transfer roller 11 can be twisted, and thus the feeding of the transfer material S becomes unstable. If the hardness exceeds 45°, the outer second transfer roller 11 exhibits insufficient second transfer efficiency due to the small width (the length in the rotational direction) of the contact area between the outer second transfer roller 11 and the intermediate transfer belt 6 in the second transfer section T2.

The hardness of the outer second transfer roller 11 can be controlled by adjusting the cell diameter of the sponge layer 11*b* or the contents of epichlorohydrin rubber and nitrile-butadiene rubber (NBR) in the rubber used for the solid rubber layer 11*c*.

The inner second transfer roller 7*b* can be a rotating roller formed of a metal such as stainless steel and having an outer diameter of about 24 mm.

Cleaning Unit

The cleaning unit for cleaning the outer second transfer roller 11 will be described below.

When toner images are continuously formed on the intermediate transfer belt 6 as described above, toner images for detection are formed between the toner images (between the image-bearing areas Q) on the intermediate transfer belt 6. The toner images for detection are transferred to the outer second transfer roller 11.

Figure 5:
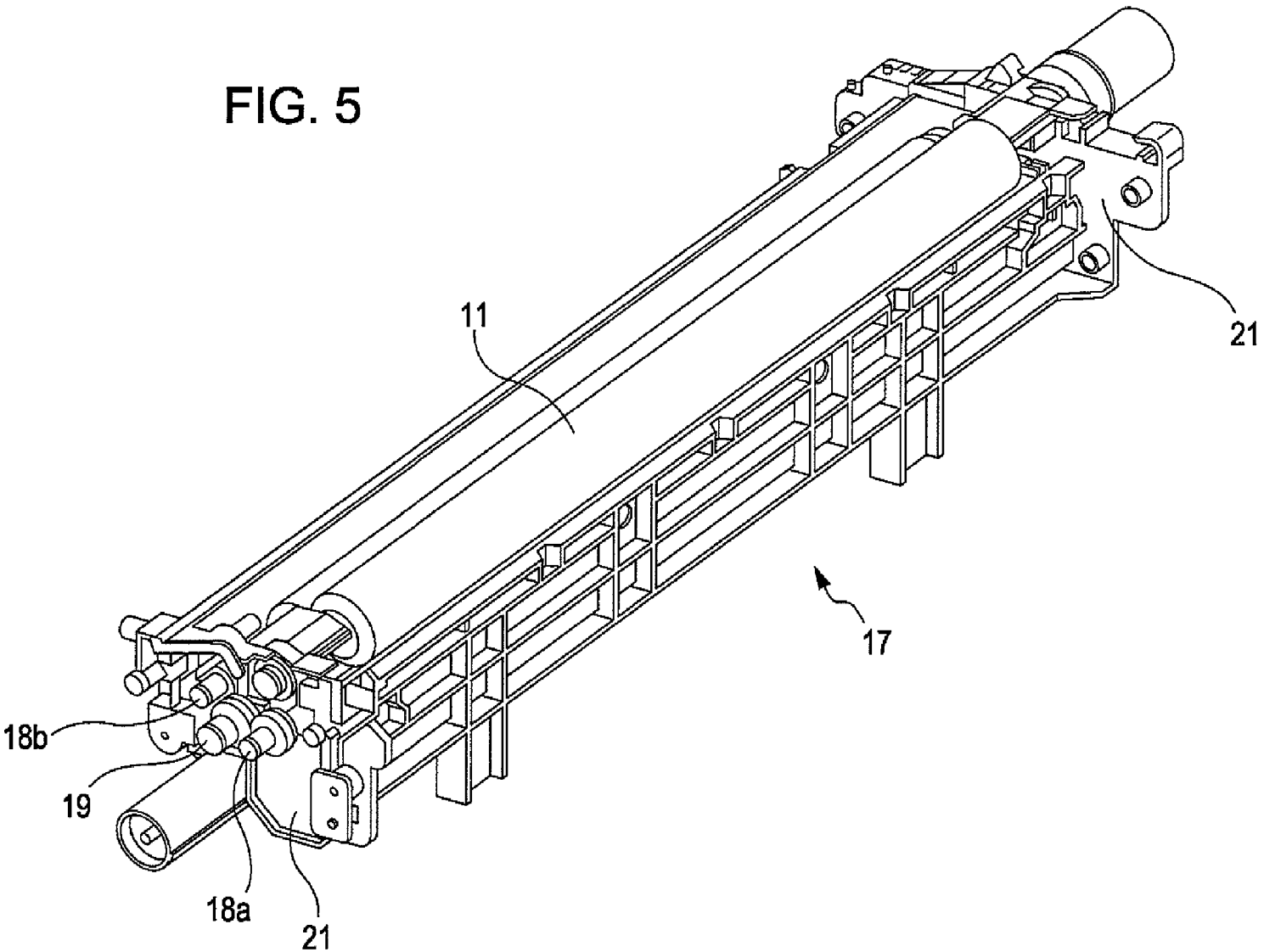
FIG. 5 is a schematic perspective view of the second transfer section in the embodiment.

The toner transferred to the outer second transfer roller 11 is difficult to remove using a blade-like member because the roller 11 is an elastic roller. The image-forming apparatus according to this embodiment includes a removing unit (cleaning unit) 17, as shown in FIGS. 4 and 5. This removing unit 17 includes two fur brush rollers (cleaning rollers) 18*a* and 18*b* that are biased to electrostatically remove the toner deposited on the outer second transfer roller 11. FIG. 4 is a schematic diagram of the removing unit 17. FIG. 5 is a perspective view of the removing unit 17.

The two fur brush rollers 18*a* and 18*b* are rotatably disposed in contact with the outer second transfer roller 11.

The two fur brush rollers 18*a* and 18*b* can be conductive rollers. A bias voltage having a polarity opposite that of the toner deposited on the outer second transfer roller 11 (i.e., a positive bias voltage) is applied to the fur brush rollers 18*a* and 18*b* to electrostatically remove and recover the toner from the outer second transfer roller 11.

In this embodiment, the two fur brush rollers 18*a* and 18*b* come in contact with the outer second transfer roller 11 and rotate in the same direction (in a direction indicated by the arrows R3 in FIG. 4). These fur brush rollers 18*a* and 18*b* can efficiently recover the toner from the outer second transfer roller 11 with a lower bias voltage than a single fur brush roller. In addition, the larger contact area between the outer second transfer roller 11 and the fur brush rollers 18*a* and 18*b* can prevent discharge between the fur brush rollers 18*a* and 18*b* and the intermediate transfer belt 6 to achieve successful cleaning.

In this embodiment, the removing unit 17 also includes a bias roller (recovery roller) 19 disposed so as to contact with the fur brush rollers 18*a* and 18*b*. This bias roller 19 has a rotating shaft that rotates in a direction indicated by the arrow R5 in FIG. 4. The bias voltage required for removal of the toner deposited on the outer second transfer roller 11 is supplied to the bias roller 19 through the ends of the rotating shaft. A current then flows to the outer second transfer roller 11, which is grounded, through the two fur brush rollers 18*a* and 18*b*. The bias roller 19 is supplied with a voltage of about 800 V from a power supply 22.

The two fur brush rollers 18*a* and 18*b* have substantially the same resistance. The power supply 22 causes a constant current to flow to the outer second transfer roller 11 through the two fur brush rollers 18*a* and 18*b*. The sum of the currents flowing through the two fur brush rollers 18*a* and 18*b* is thus kept constant.

The bias voltage applied through the bias roller 19 causes the fur brush rollers 18*a* and 18*b* to attract the toner deposited on the outer second transfer roller 11. The attracted toner is then transferred to the surface of the bias roller 19 by the action of a potential difference due to the resistance of the fur brush rollers 18*a* and 18*b*. A blade (removing member) 20 comes in contact with the surface of the bias roller 19 to scrape off and remove the toner therefrom.

The fur brush rollers 18*a* and 18*b*, the bias roller 19, and the blade 20 will be described in detail below.

The two fur brush rollers 18*a* and 18*b* have the same structure in this embodiment.

The fur brush rollers 18*a* and 18*b* may have an outer diameter of about 10 to 30 mm with the outer second transfer roller 11 being out of contact therewith. In this embodiment, the fur brush rollers 18*a* and 18*b* have an outer diameter of about 18 mm and a resistance of about $1\times10^6\Omega$. In addition, the fur brush rollers 18*a* and 18*b* have bristles with a length of about 4 mm and a density of about 120 kF/inch$^2$, and the amount of intrusion into the outer second transfer roller 11 is about 1.0 mm.

The resistance of the fur brush rollers 18*a* and 18*b* is measured as described below.

A fur brush roller is brought into contact with a metal roller having a diameter of about 30 mm with their axes of rotation (in the circumferential direction) arranged in parallel. The distance between the center of rotation of the fur brush roller and the circumferential surface of the metal roller is about 1 mm shorter than the radius of the fur brush roller. A DC voltage of about 100 V is applied to a metal core of the fur brush roller to measure the current flowing through the metal roller while the metal roller is electrically grounded and rotated at about 30 rpm. The measured current is divided by the voltage applied to the fur brush roller to determine the resistance thereof.

The measurement is performed at 25° C. and 50% RH.

The fur brush rollers 18*a* and 18*b* are determined to have substantially the same resistance if they satisfy the following condition:

$$0.9 \leqq r1/r2 \leqq 1.1$$

where r1 is the resistance of the fur brush roller 18*a* and r2 is the resistance of the fur brush roller 18*b*.

The bias roller 19 can be a rotating roller formed of a metal such as stainless steel and having an outer diameter of about 18 mm.

The blade 20 can be an elastic blade formed of, for example, polyurethane.

The blade 20 has a thickness of about 2 mm and a durometer A hardness of about 75.

In this embodiment, the single bias roller 19 is used to simultaneously apply a bias voltage for recovery of toner to the two fur brush rollers 18*a* and 18*b*. This embodiment can therefore increase space efficiency to provide a compact image-forming apparatus. In addition, this embodiment can simplify the drive structure and biasing structure of the bias roller 19.

Referring to FIG. 5, the removing unit 17 includes a common support 21 that aligns and supports the ends of the two fur brush rollers 18*a* and 18*b*, the bias roller 19, and the blade 20 in the longitudinal direction so as to maintain the relative positions thereof with high accuracy.

Figure 6:
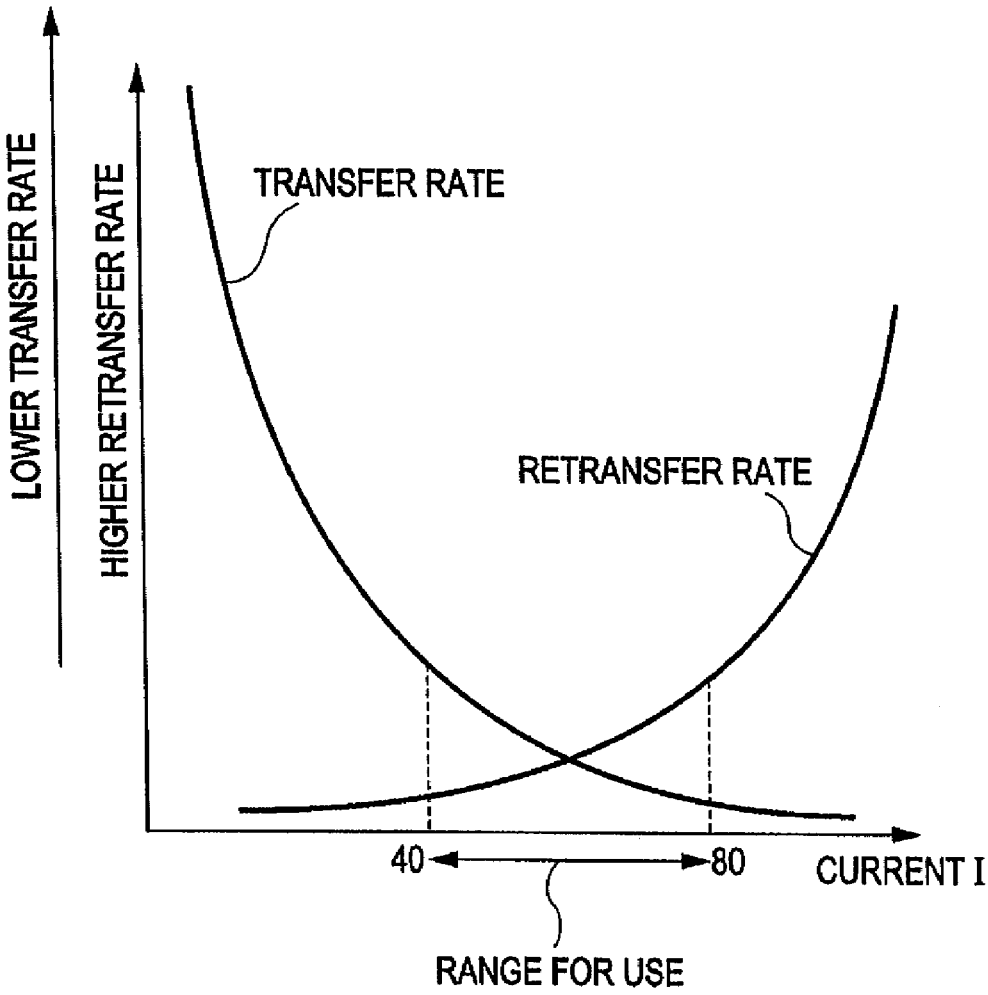
FIG. 6 is a graph showing the relationship between current and transfer rate in the embodiment.
Figure 7:
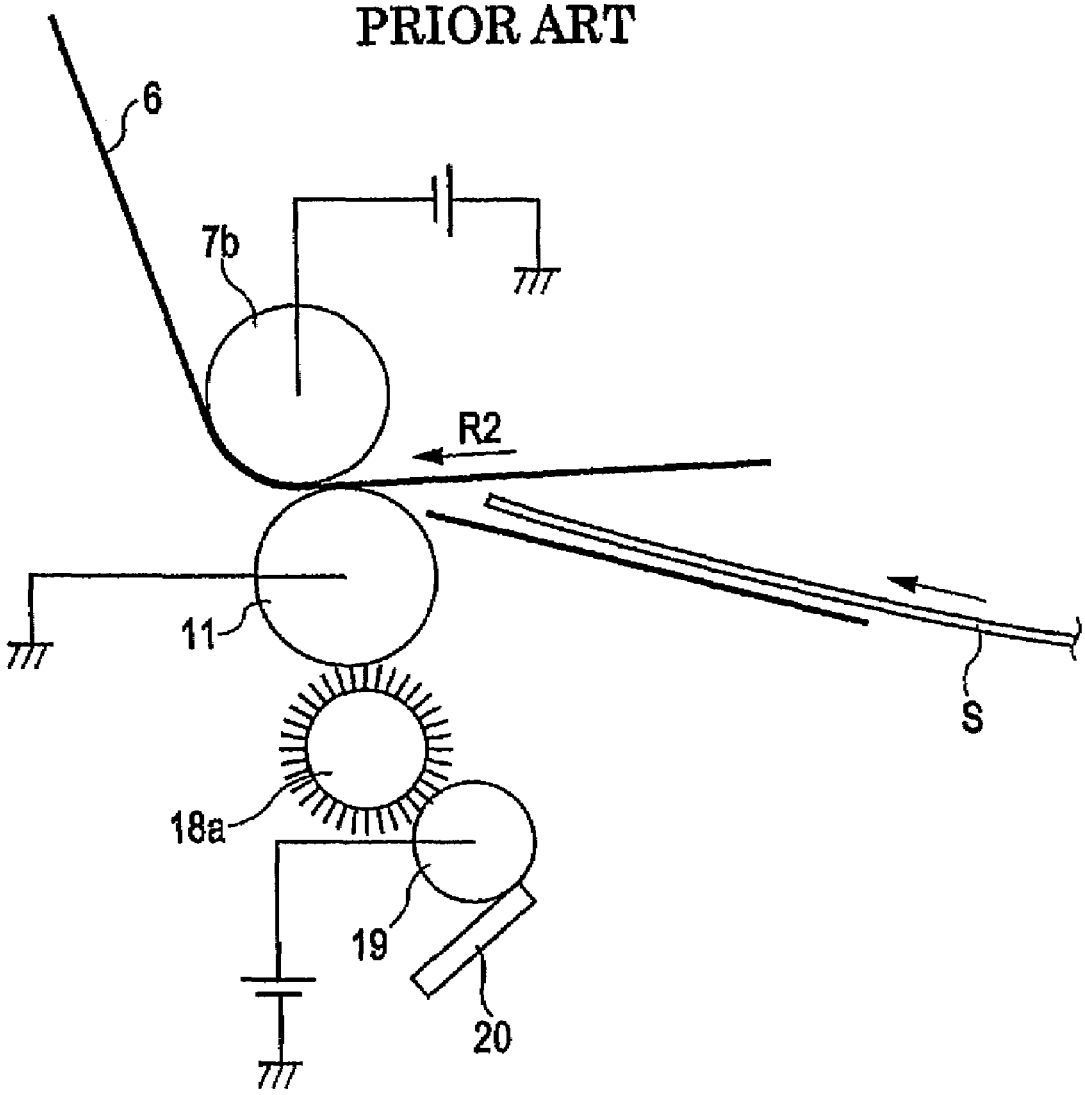
FIG. 7 PRIOR ART
FIG. 7 is a schematic diagram for illustrating a problem of the known art.

FIG. 6 is a graph showing the relationship between the transfer rate and retransfer rate of the removing unit 17 in this embodiment. The transfer rate refers to the efficiency with which toner is transferred from the outer second transfer roller 11 to the fur brush rollers 18*a* and 18*b*. The retransfer rate refers to the rate of toner retransferred from the fur brush rollers 18*a* and 18*b* to the outer second transfer roller 11. The horizontal axis of FIG. 6 indicates the current flowing through the fur brush rollers 18*a* and 18*b*.

In FIG. 6, the transfer rate and the retransfer rate increase with increasing current.

FIG. 6 shows that the current flowing from the fur brush rollers 18*a* and 18*b* to the toner may be controlled to a predetermined range (40 to 80 μA) to achieve successful cleaning. In this embodiment, as described above, the two fur brush rollers 18*a* and 18*b* are provided to increase the contact area between the outer second transfer roller 11 and the fur brush rollers 18*a* and 18*b*. The removing unit 17 can thus prevent discharge between the fur brush rollers 18*a* and 18*b* and the intermediate transfer belt 6 to achieve successful cleaning.

In this embodiment, the toner deposited on the outer second transfer roller 11 is removed by rotating the two fur brush rollers 18*a* and 18*b* in the same direction as the rotational direction of the outer second transfer roller 11. Accordingly, the fur brush rollers 18*a* and 18*b* and the outer second transfer roller 11 rub against each other in opposite directions at positions where they come in contact with each other. The fur brush rollers 18*a* and 18*b* can thus mechanically scrape the toner off the outer second transfer roller 11 to facilitate the removal of the toner from the outer second transfer roller 11.

In addition, the surfaces of the fur brush roller 18*a* and the outer second transfer roller 11 move at different velocities at a contact position X1 therebetween.

Similarly, the surfaces of the fur brush roller 18*b* and the outer second transfer roller 11 move at different velocities at a contact position X2 therebetween.

In this embodiment, the surface of the fur brush roller 18*a* moves at about 75 mm/s in the direction indicated by the arrow R3. The surface of the outer second transfer roller 11 moves at about 300 mm/s in the direction indicated by the arrow R4.

The relative speed ratio of the fur brush roller 18*a* to the outer second transfer roller 11 is defined as |Vb1−Va|/|Va|, where Vb1 is the surface velocity of the fur brush roller 18*a* at the contact position X1 and Va is the surface velocity of the outer second transfer roller 11 at the contact position X1.

The surface velocities of the fur brush roller 18*a* and the outer second transfer roller 11 may be measured at positions other than the contact position X1 and used as approximate values.

The relative speed ratio may thus be determined from measurements of |Vb1| and |Va| at positions other than the contact position X1.

The relative speed ratio of the fur brush roller 18*a* to the outer second transfer roller 11 in this embodiment can be determined as described below.

The values of |Va| and |Vb1| are 300 mm/s and 75 mm/s, respectively, in this embodiment.

The surface velocity of the fur brush roller 18*a* has the direction opposite that of the surface velocity of the outer second transfer roller 11 at the contact position X1 because they rotate in the same direction.

Hence, the relative speed can be determined as follows:

$$|Vb1-Va|=|-75\text{ mm/s}-300\text{ mm/s}|=375\text{ mm/s}$$

It should be noted that the surface velocity of the fur brush roller 18*a* is positive in sign if the velocity has the same direction as that of the outer second transfer roller 11 at the contact position X1.

The relative speed ratio in this embodiment can thus be determined as follows:

$$|Vb1-Va|/|Va|=375/300=1.25$$

The surface of the fur brush roller 18*b* moves at about 75 mm/s in the direction indicated by the arrow R3. The relative speed ratio of the fur brush roller 18*b* to the outer second transfer roller 11 can be similarly determined, that is:

$$|Vb2-Va|/|Va|=375/300=1.25$$

where Vb2 is the surface velocity of the fur brush roller 18*b* at the contact position X2 and Va is the surface velocity of the outer second transfer roller 11 at the contact position X2.

The relative speed ratios of the fur brush rollers 18*a* and 18*b* to the outer second transfer roller 11 may be adjusted to 1.0 or more in terms of toner recovery rate. In particular, the relative speed ratios may be adjusted to about 1.1 to 1.5 to reduce the time when the fur brush rollers 18*a* and 18*b* come in contact with the outer second transfer roller 11, facilitate mechanical cleaning, and reduce the amount of toner scattered. That is, the fur brush roller 18*a* and the outer second transfer roller 11 may satisfy the following relationship:

$$1.1|Va| \leqq |Vb1-Va| \leqq 1.5|Va|$$

Similarly, the fur brush roller 18*b* and the outer second transfer roller 11 may satisfy the following relationship:

$$1.1|Va| \leqq |Vb2-Va| \leqq 1.5|Va|$$

The removing unit 17, as described above, can successfully remove the toner transferred to the outer second transfer roller 11.

The removing unit 17 is used to clean the outer second transfer roller 11 in this embodiment, although the removing unit 17 may be used to clean another member.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-264854 filed Sep. 13, 2005, which is hereby incorporated by reference herein in its entirety.

What is claimed is:

1. An image-forming apparatus comprising:

an image-bearing member configured to bear a toner image;

a transfer member contacting with the image-bearing member so as to transfer the toner image from the image bearing member to a recording material;

first and second cleaning members contacting with the transfer member so as to remove toner from the transfer member;

a collecting member contacting with the first and second cleaning members so as to collect toner from the first and second cleaning members; and a power supply configured to supply electric power to the collecting member, wherein a potential difference between the transfer member and the first cleaning member, the potential difference generated by applying a voltage to the collecting member from the power supply, causes the first cleaning member to collect the toner on the transfer member, and a potential difference between the transfer member and the second cleaning member, the potential difference generated by applying a voltage to the collecting member from the power supply, causes the second cleaning member to collect the toner on the transfer member.

2. An image-forming apparatus according to claim 1, further comprising a cleaning blade configured to remove toner from the collecting member.

3. An image-forming apparatus according to claim 1, wherein the first and second cleaning members rotate in the same direction as the rotational direction of the transfer roller.

4. An image-forming apparatus according to claim 3, wherein, at regions where the transfer member comes in contact with the first and second cleaning members, a surface of the transfer roller moves at a velocity different from a velocity at which a surface the first cleaning member moves and a velocity at which a surface of the second cleaning member moves.

5. An image-forming apparatus according to claim 4, wherein the surface velocity of the transfer member at the contacting regions with the first and second cleaning members (Va), the surface velocity of the first cleaning member at the contacting region with the transfer member (Vb1), and the surface velocity of the second cleaning member at the contacting region with the transfer member (Vb2) satisfy the following relationship:

$$1.1|Va| \leqq |Vb1-Va| \leqq 1.5|Va|, and$$

$$1.1|Va| \leqq |Vb2-Va| \leqq 1.5|va|.$$

6. An image-forming apparatus according to claim 1, wherein a potential difference between the first cleaning member and the collecting member, the potential difference generated by applying a voltage to the collecting member from the power supply, causes the collecting member to collect the toner on the collecting member.

7. An image-forming apparatus according to claim 1, wherein the power supply applies a voltage having polarity opposite a regular polarity of the toner to the collecting member.

* * * * *